US006802577B2

(12) United States Patent
Gershfeld

(10) Patent No.: US 6,802,577 B2
(45) Date of Patent: Oct. 12, 2004

(54) ENCLOSURE SYSTEM FOR ELECTRONIC EQUIPMENT CONCEALABLE IN A TABLE TOP

(76) Inventor: Jack Gershfeld, 615 Del Rio Way, Fullerton, CA (US) 92835

( * ) Notice: Subject to any disclaimer, the term of this patent is extended or adjusted under 35 U.S.C. 154(b) by 178 days.

(21) Appl. No.: 10/277,278

(22) Filed: Oct. 21, 2002

(65) Prior Publication Data

US 2004/0075373 A1 Apr. 22, 2004

(51) Int. Cl.[7] ..... A47B 97/00

(52) U.S. Cl. ..... 312/223.3; 312/319.2; 108/50.01

(58) Field of Search ..... 312/223.1, 223.3, 312/317.3, 319.2, 327, 194; 108/50.01, 50.02; 248/917, 919, 923

(56) References Cited

U.S. PATENT DOCUMENTS

| | | | | | |
|---|---|---|---|---|---|
| 3,131,512 | A | | 5/1964 | MacLeod, Jr. | |
| 3,433,886 | A | | 3/1969 | Myers | |
| 3,992,070 | A | | 11/1976 | Dunn et al. | |
| 4,562,482 | A | * | 12/1985 | Brown | 312/223.3 |
| 4,654,756 | A | | 3/1987 | Wilson et al. | |
| 4,669,789 | A | * | 6/1987 | Pemberton | 312/223.3 |
| 4,792,881 | A | | 12/1988 | Wilson et al. | |
| 4,984,982 | A | | 1/1991 | Brownlie et al. | |
| 5,023,396 | A | | 6/1991 | Bartee et al. | |
| 5,122,069 | A | | 6/1992 | Brownlie et al. | |
| 5,230,552 | A | | 7/1993 | Schipper et al. | |
| 5,231,562 | A | | 7/1993 | Pierce et al. | |
| 5,351,173 | A | | 9/1994 | Byrne | |
| 5,480,224 | A | * | 1/1996 | Ugalde | 312/194 |
| 5,575,668 | A | | 11/1996 | Timmerman | |
| 5,655,823 | A | * | 8/1997 | Schairbaum | 312/194 |
| 5,709,156 | A | | 1/1998 | Gevaert et al. | |
| 5,746,489 | A | * | 5/1998 | Moon | 312/223.3 |
| 5,758,934 | A | * | 6/1998 | Flutka et al. | 312/223.3 |
| 5,888,078 | A | | 3/1999 | Lecreux et al. | |
| 5,980,279 | A | | 11/1999 | Müller | |
| 6,028,267 | A | | 2/2000 | Byrne | |
| 6,046,405 | A | | 4/2000 | Obermann | |
| 6,085,667 | A | | 7/2000 | Gevaert et al. | |
| 6,086,173 | A | * | 7/2000 | Restell | 312/223.3 |
| 6,092,883 | A | * | 7/2000 | Lechman | 312/223.3 |
| 6,127,630 | A | | 10/2000 | McKenzie et al. | |
| 6,170,406 | B1 | * | 1/2001 | Klein et al. | 108/50.01 |

FOREIGN PATENT DOCUMENTS

| | | | | |
|---|---|---|---|---|
| DE | 4100675 | * | 7/1992 | 312/223.3 |
| EP | 592181 | * | 4/1994 | 312/223.3 |

OTHER PUBLICATIONS

Advertising materials for the product identified as TNP100 by Altinex found on the web site http://www.altinex.com/Products/Designer_Solutions/tnp100.htm.

Advertising materials for the products identified as HSA 200 by Extron found on the web site http://www.extron.com/download/files/brochure/HSA200Seriesebro.pdf.

* cited by examiner

*Primary Examiner*—Lanna Mai
*Assistant Examiner*—Hanh V. Tran
(74) *Attorney, Agent, or Firm*—Vladimir Khiterer

(57) ABSTRACT

An enclosure system for electronic equipment concealable in a table top is disclosed. The enclosure system has a saddle attached to a bezel. The saddle defines an open area for receiving an enclosure. The bezel defines an opening for receiving a top plate of the enclosure. An outer perimeter of the bottom surface of the bezel rests on edges of an opening cut through a table top. The enclosure pivots from a concealed position, in which the top plate is flush with the bezel, to an open position in which the face plate of the enclosure is exposed. A spring biases the enclosure towards the open position, while a latch maintains the enclosure in the concealed position.

9 Claims, 8 Drawing Sheets

ENCLOSURE SYSTEM FOR ELECTRONIC EQUIPMENT CONCEALABLE IN A TABLE TOP

BACKGROUND OF THE INVENTION

This invention pertains to an enclosure system for electronic equipment, such as interconnect equipment for audio/visual presentation systems, concealable in a table top. The central element of many audio/visual presentation systems is some sort of table or countertop. The challenge that faces the system designer is how to provide an input plate in the table for computer video, video, audio, network, and AC power connections without making an obstruction that gets in the way when it isn't needed.

Enclosure systems housing such input plates and other equipment that can be concealed in the table top when not in use offer improved user-friendliness, aesthetic design, and flexibility. To work properly and endure constant openings and closings, such enclosure systems must have solid and sturdy foundation to provide support for the mechanical components of the system. The prior art enclosures of this type utilize a box-like structure mounted underneath the table that provides support for the mechanical elements of the enclosure and receives the enclosure when it is in the closed (or concealed) position. However, the cost to manufacture such a box-like structure, vis-à-vis the cost of the entire enclosure system, is high. As such, there is need for an alternative to the box-like structure to serve as the foundation of the enclosure system, which is inexpensive and at the same time sturdy and easy to install in an opening cut through a table top.

SUMMARY OF THE INVENTION

The enclosure system for electronic equipment concealable in a table top of the present invention satisfies this need. It comprises a saddle with a base and two vertical legs on the opposite sides of the base attached to a bezel at the upper ends of the legs. The legs and the base define an open area for receiving an enclosure. The bezel defines an opening for receiving a top plate of the enclosure. An outer perimeter of the bottom surface of the bezel rests on edges of an opening cut through a table top.

The enclosure can be selectively pivotally moved from a concealed position in which the top plate is flush with the bezel to an open position in which the face plate of the enclosure is exposed. A spring means biases the enclosure towards the open position, while a latch selectively maintains the enclosure in the concealed position.

BRIEF DESCRIPTION OF THE DRAWINGS FIGURES

DETAILED DESCRIPTION OF THE PREFERRED EMBODIMENTS

Figure 1:
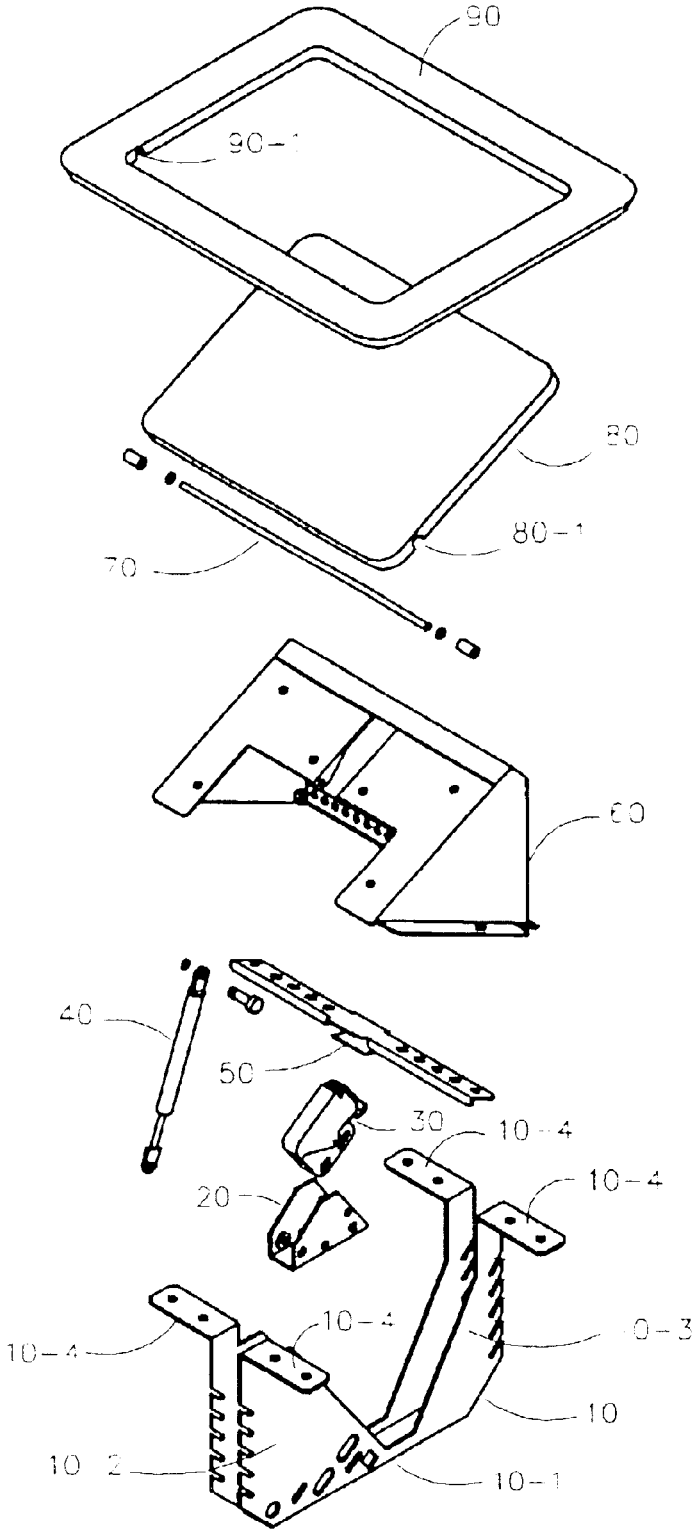
FIG. 1 shows exploded isometric view of the enclosure system according to the preferred embodiment of the present invention.

This invention will be better understood with the reference to the drawing figures FIG. 1 through FIG. 8. The same numerals refer to the same elements in all drawing figures.

Viewing FIG. 1, numeral 10 indicates a saddle. Saddle 10 comprises a base member indicated by numeral 10-1, a first vertical leg indicated by numeral 10-2 and a second vertical leg indicated by numeral 10-3. First Vertical Leg 10-2 extends up from one end of Base Member 10-1 and terminates in a first upper end. Second Vertical Leg 10-2 extends up from an opposite end of Base Member 10-1 and terminates in a second upper end. Numeral 10-4 indicates attachment means disposed on the first upper end and the second upper end.

Still viewing FIG. 1, numerals 20 and 30 collectively indicate a latch means comprised of a latch holding member indicated by numeral 20 and a latch indicated by numeral 30. Numeral 40 indicates a spring means. Numeral 50 indicates a catch means. Numeral 60 indicates an enclosure. Enclosure 60 is suitable for housing electronic equipment and comprises a face plate, a top portion, two opposite side walls and a bottom portion.

Still viewing FIG. 1, numeral 70 indicates a hinge means. Numeral 80 indicates a top plate. Numeral 90 indicates a bezel. Bezel 90 comprises a top surface and a bottom surface and defines an opening for receiving Top Plate 80. An outer perimeter of the bottom surface of Bezel 90 is for resting on edges of an opening cut through a table top (the table top is not shown in FIG. 1). Numerals 80-1 and 90-1 indicate bores for receiving Hinge Means 70.

Viewing now FIG. 2 through FIG. 6, Saddle 10 is fixedly attached to the bottom surface of Bezel 90 by way of Attachment Means 10-4. Top Plate 80 is fixedly attached to the top portion of Enclosure 60. First Vertical Leg 10-2, Second Vertical Leg 10-3 and Base Member 10-1 together define an open area for receiving Enclosure 60 therein. Top Plate 80 is pivotally mounted to Bezel 90 by way of Hinge Means 70 received in Bores 80-1 and 90-1 for pivotal movement of Enclosure 60 from a concealed position in which Top Plate 80 is flush with Bezel 90 (shown in FIG. 2 and FIG. 3) to an open position in which the face plate of Enclosure 60 is exposed (shown in FIG. 4 and FIG. 5).

Still viewing FIG. 2 through FIG. 6, Latch Holding Member 20 is fixedly attached to First Vertical Leg 10-2, Latch 30 is fixedly attached to Latch Holding Member 20 and Catch Means 50 is fixedly attached to the bottom portion of Enclosure 60 such that Latch 30 selectively maintains Enclosure 60 in the concealed position by way of engaging with Catch Means 50. Specifically, Catch Means 50 is shown in FIG. 1 through FIG. 6 as a hook. Latch 30 comprises a spring loaded roller indicated by numeral 30-1. Spring Loaded Roller 30-1 is for engaging with the hook of Catch Means 50.

Still viewing FIG. 2 through FIG. 6, Spring Means 40 comprises a proximal end pivotally attached to First Vertical Leg 10-2 and a distal end pivotally attached to Enclosure 60, thereby biasing Enclosure 60 towards the open position. To launch Enclosure 60 in the open position, one would push on Top Plate 80 causing Spring Loaded Roller 30-1 to disengage with the hook of Catch Means 50. This will cause Spring Means 40 to push Enclosure 60 up. To conceal Enclosure 60, one would push on Top Plate 80 until Spring Loaded Roller 30-1 engages with the hook of Catch Means 50.

Still viewing FIG. 2 through FIG. 6, Saddle 10 further comprises a plurality of teeth indicated by numeral 10-5. Teeth 10-5 are disposed along outer edges of First Vertical Leg 10-2 and Second Vertical Leg 10-3. Teeth 10-5 extend upwardly at a substantially forty five degree angle in relation to the outer edges of First Vertical Leg 10-2 and Second Vertical Leg 10-3 and define spaces therebetween for effecting insertion of holding plates indicated by numeral 10-6. Holding Plates 10-6 are formed from strips of bent sheet metal and comprise openings for receiving lag screws indicated by numeral 10-7. Lag Screws 10-7 are for biasing Holding Plates 10-6 inserted in said spaces in the direction opposite to a bottom of the table top, thereby securing Saddle 10 to the tabletop (the table top with an opening for receiving the enclosure system of this invention is shown in FIG. 2, FIG. 3, FIG. 4 and FIG. 5).

Figure 2:
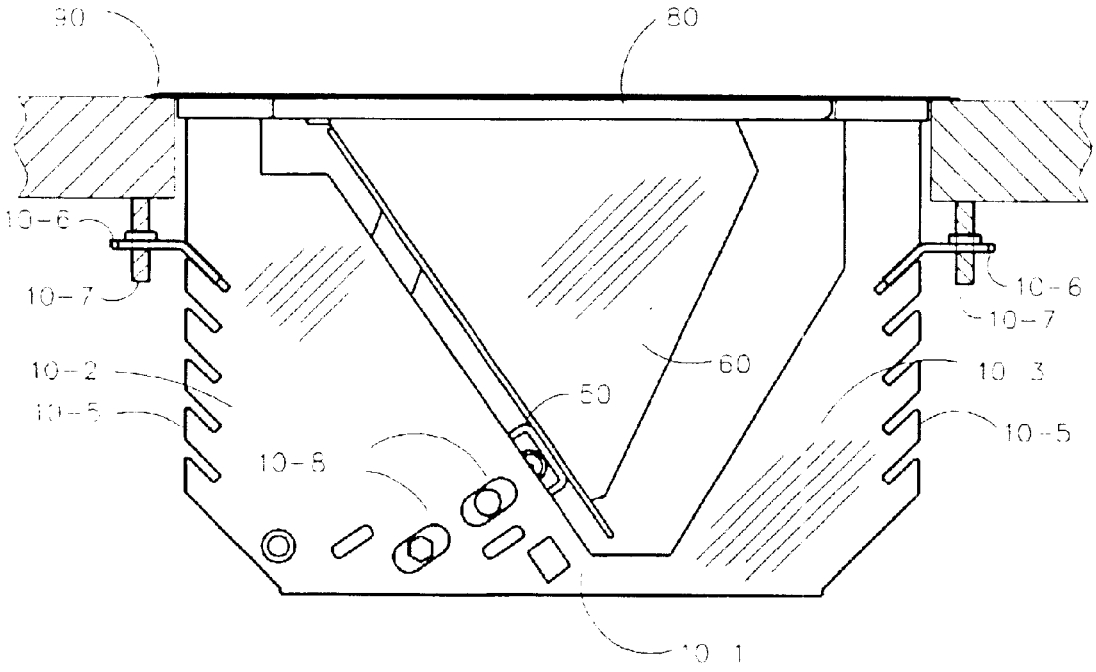
FIG. 2 shows side elevational view of the enclosure system according to the preferred embodiment of the present invention in the concealed position.
Figure 3:
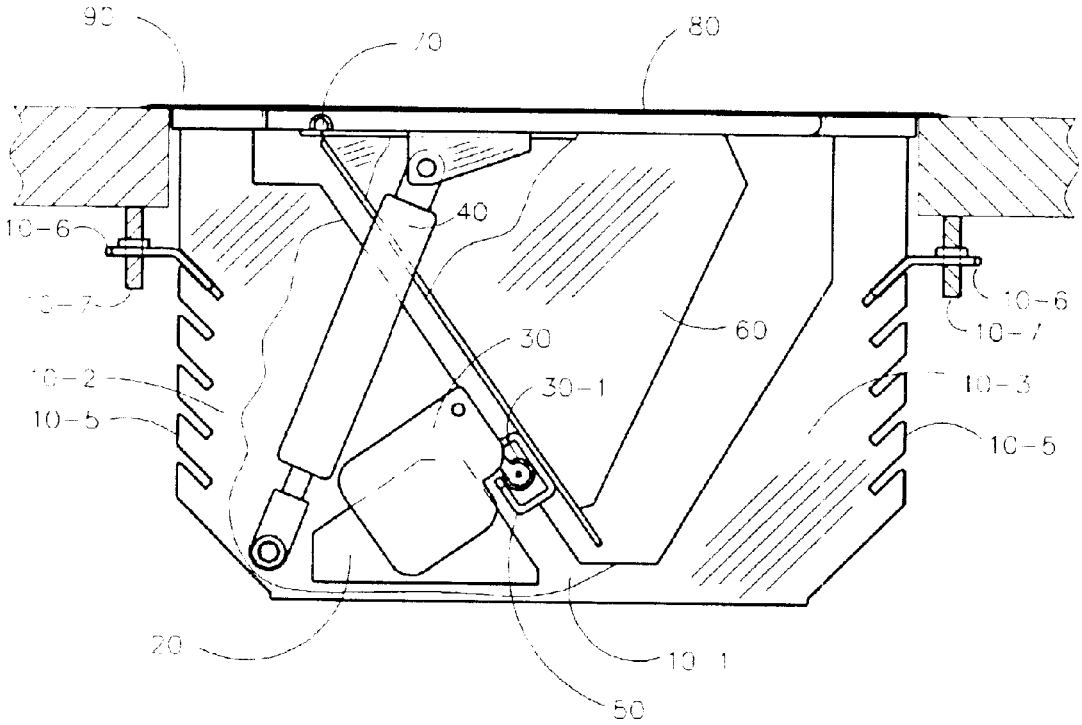
FIG. 3 shows side partially cut out elevational view of the enclosure system according to the preferred embodiment of the present invention in the concealed position.
Figure 4:
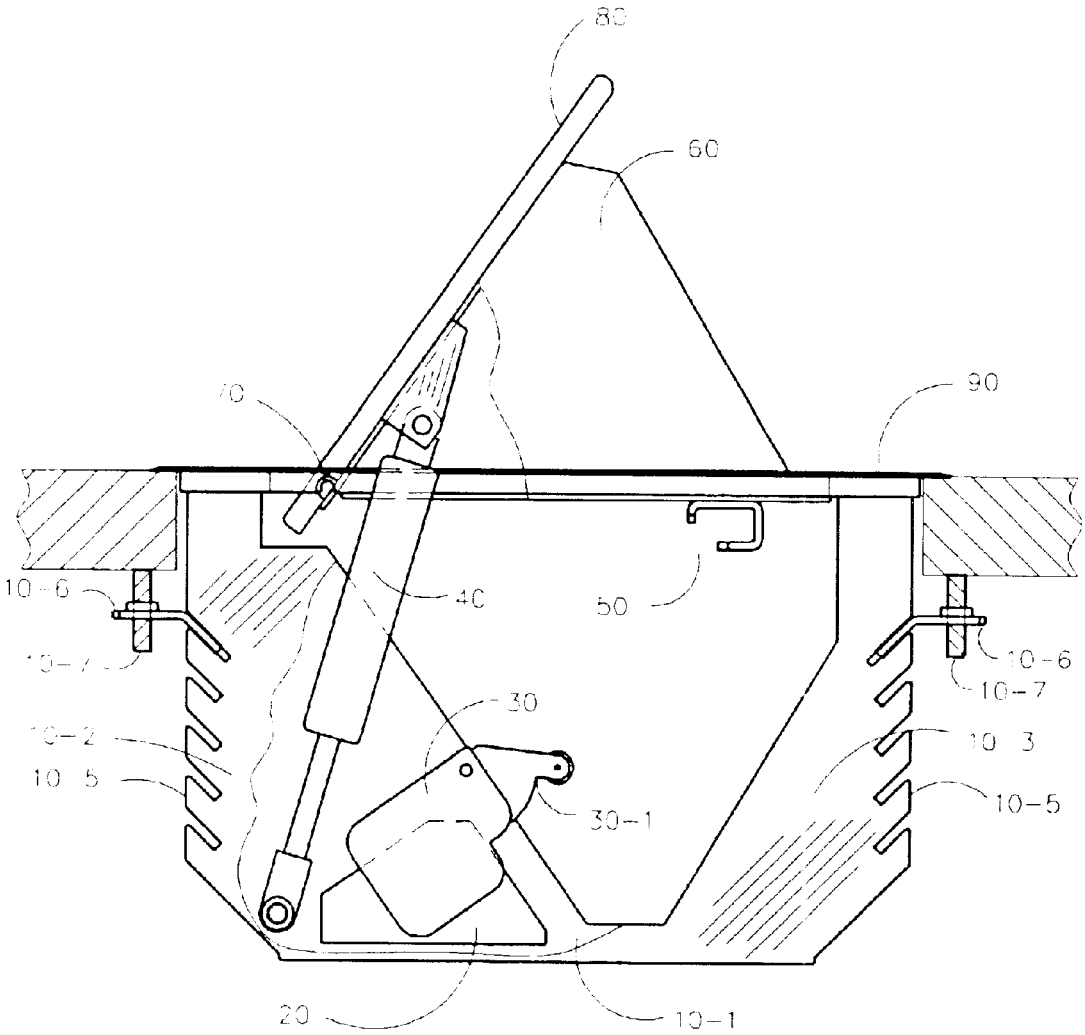
FIG. 4 shows side partially cut out elevational view of the enclosure system according to the preferred embodiment of the present invention in the open position.
Figure 5:
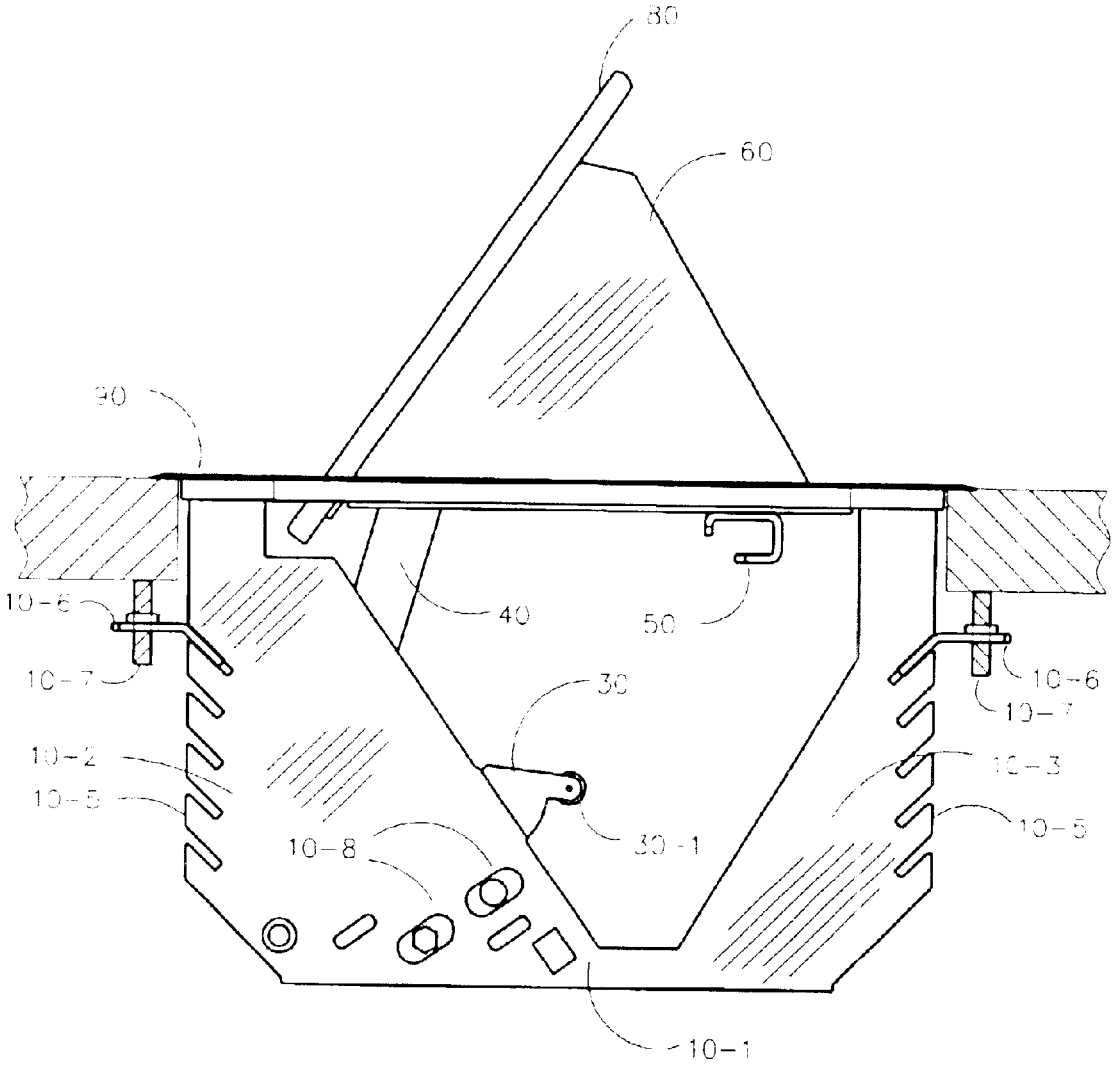
FIG. 5 shows side elevational view of the enclosure system according to the preferred embodiment of the present invention in the open position.
Figure 6:
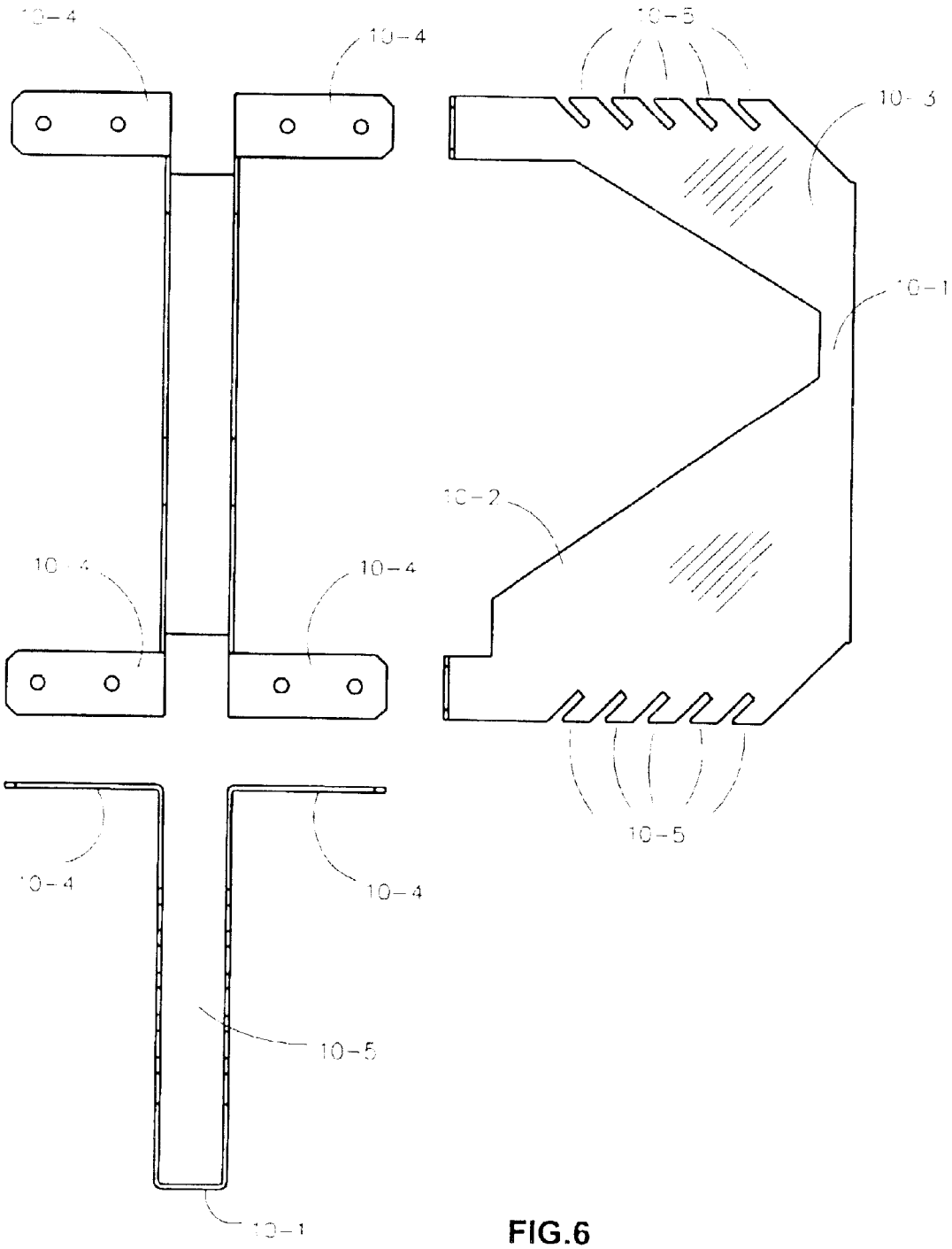
FIG. 6 shows the top plan, side elevational and front elevational views of a saddle of the enclosure system according to the preferred embodiment of the present invention.

Viewing now FIG. 2 and FIG. 5, First Vertical Leg 10-2 further comprises two elongated openings indicated by numeral 10-8. Elongated Openings 10-8 are for receiving screws for attaching Latch Holding Member 20 to First Vertical Leg 10-2 such that the position of Latch Holding Member 20 can be adjusted prior to fixedly attaching Latch Holding Member 20 to First Vertical Leg 10-2 by way of said screws. Such adjustment allows to ensure that when Enclosure 60 is in the concealed position (i.e. Spring Loaded Roller 30-1 is engaged with the hook of Catch Means 50), Top Plate 80 is flush with Bezel 90.

Further, Saddle 10 and Latch Holding Member 20 are shown in FIG. 1 through FIG. 6 as formed from bent sheet metal. However, Saddle 10 and/or Latch Holding Member 20 can be also formed from machined metal, cast metal, bent wire or plastic.

Figure 7:
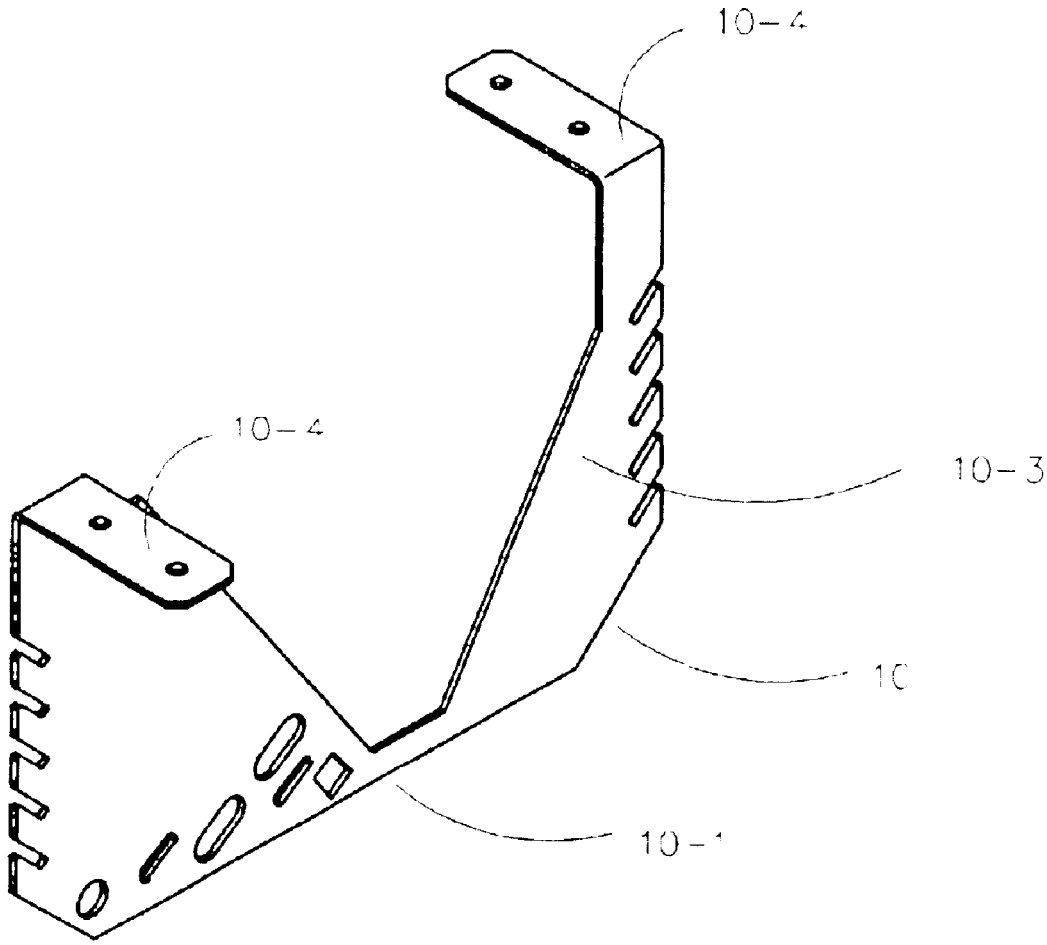
FIG. 7 shows an isometric view of a saddle of the enclosure system according to an alternative embodiment of the present invention.

Viewing now FIG. 7, there is shown Saddle 10 according to an alternative embodiment of this invention. Specifically, unlike Saddle 10 that has double walls formed from bent sheet metal shown in FIG. 1 through FIG. 6, Saddle 10 in FIG. 7 is formed with only one wall. Also, Saddle 10 shown in FIG. 1 through FIG. 6 has four Attachment Means 10-4 formed as flanges having planes substantially parallel to the table top. These flanges are bent from the first upper end and the second upper end and have openings for receiving screws for attachment to Bezel 90. However, Saddle 10 in FIG. 7 has only two such flanges.

Figure 8:
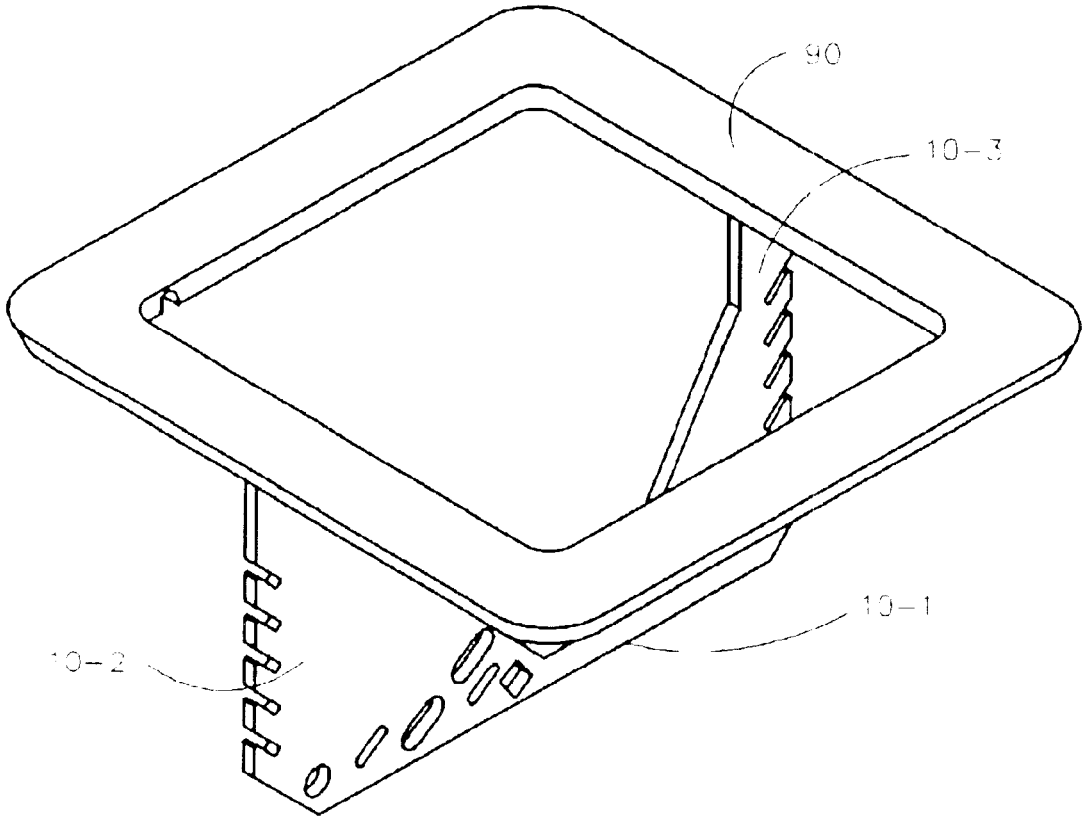
FIG. 8 shows an isometric view of a saddle and bezel of the enclosure system according to another alternative embodiment of the present invention.

Viewing now FIG. 8, there is shown another embodiment of this invention in which Saddle 10 and Bezel 90 are formed from one piece of cast metal.

While the present invention has been described and defined by reference to the preferred embodiment of the invention, such reference does not imply a limitation on the invention, and no such limitation is to be inferred. The invention is capable of considerable modification, alteration, and equivalents in form and function, as will occur to those ordinarily skilled and knowledgeable in the pertinent arts. The depicted and described preferred embodiment of the invention is exemplary only, and is not exhaustive of the scope of the invention. Consequently, the invention is intended to be limited only by the spirit and scope of the appended claims, giving full cognizance to equivalents in all respects.

What is claimed is:

1. An enclosure system for electronic equipment concealable in a table top comprising:

(1) a saddle;

(2) a latch means;

(3) a spring means;

(4) a catch means;

(5) an enclosure suitable for housing electronic equipment and comprising a face plate, a top portion, two opposite side walls and a bottom portion;

(6) a top plate fixedly attached to the top portion of the enclosure;

(7) a bezel comprising a top surface and a bottom surface, the bezel defining an opening for receiving the top plate, wherein an outer perimeter of the bottom surface is for resting on edges of an opening cut through a table top;

(8) a hinge means;

wherein the saddle comprises:

a base member;

a first vertical leg extending up from one end of the base member and terminating in a first upper end;

a second vertical leg extending up from an opposite end of the base member and terminating in a second upper end, the first and second vertical legs and the base member together defining an open area for receiving the enclosure therein;

attachment means disposed on the first upper end and the second upper end fixedly attaching the saddle to the bottom surface of the bezel;

wherein the top plate is pivotally mounted to the bezel by way of the hinge means for pivotal movement of the enclosure from a concealed position in which the top plate is flush with the bezel to an open position in which the face plate is exposed;

wherein the latch means is fixedly attached to the first vertical leg and the catch means is fixedly attached to the bottom portion of the enclosure such that the latch means selectively maintains the enclosure in the concealed position by way of engaging with the catch means;

wherein the spring means comprises a proximal end pivotally attached to the first vertical leg and a distal end pivotally attached to the enclosure thereby biasing the enclosure towards the open position.

2. An enclosure system as in claim 1, wherein the saddle is formed from the material selected from the group consisting of bent sheet metal, machined metal, cast metal, bent wire and plastic.

3. An enclosure system as in claim 2, wherein the saddle further comprises a plurality of teeth disposed along outer edges of the first and second vertical legs, the teeth extending upwardly at a substantially forty five degree angle in relation to the outer edges and defining spaces therebetween for effecting insertion of holding plates, said holding plates being formed from strips of bent sheet metal and comprising openings for receiving lag screws for biasing the holding plates inserted in said spaces in the direction opposite to a bottom of the table top, thereby securing the saddle to the tabletop.

4. An enclosure system as in claim 3, wherein the catch means is a hook formed from the material selected from the group consisting of bent sheet metal, machined metal, cast metal, bent wire and plastic and wherein the latch means further comprises:

a latch holding member formed from bent sheet metal, the latch holding member fixedly attached to the first vertical leg;

a latch fixedly attached to the latch holding member, the latch comprising a spring loaded roller for engaging with the hook.

5. An enclosure system as in claim 4, wherein the first vertical leg further comprises a plurality of elongated openings for receiving screws for attaching the latch holding member to the first vertical leg such that the position of the latch holding member can be adjusted prior to fixedly attaching the latch holding member to the first vertical leg by way of said screws.

6. An enclosure system for electronic equipment concealable in a table top comprising:

(1) a saddle and a bezel formed from one piece of cast metal;

(2) a latch means;

(3) a spring means;

(4) a catch means;

(5) an enclosure suitable for housing electronic equipment and comprising a face plate, a top portion, two opposite side walls and a bottom portion;

(6) a top plate fixedly attached to the top portion of the enclosure;

(7) a hinge means;

wherein the saddle comprises:

a base member;

a first vertical leg extending up from one end of the base member and terminating in a first upper end;

a second vertical leg extending up from an opposite end of the base member and terminating in a second upper end, the first and second vertical legs and the base member together defining an open area for receiving the enclosure therein;

wherein the bezel comprises a top surface and a bottom surface, the bezel defining an opening for receiving the top plate, wherein an outer perimeter of the bottom surface is for resting on edges of an opening cut through a table top and wherein the saddle is attached to the bottom surface of the bezel at the first upper end and the second upper end;

wherein the top plate is pivotally mounted to the bezel by way of the hinge means for pivotal movement of the enclosure from a concealed position in which the top plate is flush with the bezel to an open position in which the face plate is exposed;

wherein the latch means is fixedly attached to the first vertical leg and the catch means is fixedly attached to the bottom portion of the enclosure such that the latch means selectively maintains the enclosure in the concealed position by way of engaging with the catch means;

wherein the spring means comprises a proximal end pivotally attached to the first vertical leg and a distal end pivotally attached to the enclosure thereby biasing the enclosure towards the open position.

7. An enclosure system as in claim 6, wherein the saddle further comprises a plurality of teeth disposed along outer edges of the first and second vertical legs, the teeth extending upwardly at a substantially forty five degree angle in relation to the outer edges and defining spaces therebetween for effecting insertion of holding plates, said holding plates being formed from strips of bent sheet metal and comprising openings for receiving lag screws for biasing the holding plates inserted in said spaces in the direction opposite to a bottom of the table top, thereby securing the saddle to the tabletop.

8. An enclosure system as in claim 7, wherein the catch means is a hook formed from the material selected from the group consisting of bent sheet metal, machined metal, cast metal, bent wire and plastic and wherein the latch means further comprises:

a latch holding member formed from bent sheet metal, the latch holding member fixedly attached to the first vertical leg;

a latch fixedly attached to the latch holding member, the latch comprising a spring loaded roller for engaging with the hook.

9. An enclosure system as in claim 8, wherein the first vertical leg further comprises a plurality of elongated openings for receiving screws for attaching the latch holding member to the first vertical leg such that the position of the latch holding member can be adjusted prior to fixedly attaching the latch holding member to the first vertical leg by way of said screws.

* * * * *